US007381318B2

(12) United States Patent
Yoo et al.

(10) Patent No.: US 7,381,318 B2
(45) **Date of Patent: *Jun. 3, 2008**

(54) METHOD OF MANUFACTURING BIAXIALLY TEXTURED METALLIC LAYER FEATURED BY ELECTROPLATING ON THE SURFACE OF SINGLE-CRYSTALLINE OR QUASI-SINGLE-CRYSTALLINE METAL SURFACE, AND ARTICLES THEREFROM

(75) Inventors: Jai-Moo Yoo, Kyungsangnam-do (KR); Young-Kuk Kim, Kyungsangnam-do (KR); Jae-Woong Ko, Kyungsangnam-do (KR); Kyu-Hwan Lee, Kyungsangnam-do (KR); Do-Yon Chang, Kyungsangnam-do (KR)

(73) Assignee: Korea Institute of Machinery and Materials, Daejeon (KR)

( * ) Notice: Subject to any disclaimer, the term of this patent is extended or adjusted under 35 U.S.C. 154(b) by 385 days.

This patent is subject to a terminal disclaimer.

(21) Appl. No.: 10/608,678

(22) Filed: Jun. 27, 2003

(65) Prior Publication Data

US 2004/0195105 A1 Oct. 7, 2004

(30) Foreign Application Priority Data

Apr. 3, 2003 (KR) ..... 10-2003-0021091

(51) Int. Cl.

| | |
|---|---|
| ***C25D 1/00*** | (2006.01) |
| ***C25D 1/04*** | (2006.01) |
| ***C25D 5/00*** | (2006.01) |
| ***C25D 5/18*** | (2006.01) |
| ***C25D 7/06*** | (2006.01) |

(52) U.S. Cl. ..... 205/67; 205/76; 205/77; 205/103; 205/104; 205/137; 205/138; 205/151; 205/255; 205/271

(58) Field of Classification Search ..... 205/51, 205/238, 255, 261, 271, 137, 138, 76, 67, 205/103, 104, 77, 151

See application file for complete search history.

(56) References Cited

U.S. PATENT DOCUMENTS

| | | | | |
|---|---|---|---|---|
| 6,346,181 | B1 * | 2/2002 | Lee et al. | 205/89 |
| 6,361,673 | B1 * | 3/2002 | Ameen et al. | 205/77 |
| 2004/0206630 | A1 * | 10/2004 | Kruger et al. | 205/223 |
| 2006/0159949 | A1 * | 7/2006 | Yoo et al. | 428/680 |

FOREIGN PATENT DOCUMENTS

| | | | |
|---|---|---|---|
| DE | 10136890 | A1 * | 2/2003 |
| WO | WO 0183855 | A1 * | 11/2001 |

OTHER PUBLICATIONS

Lowenheim, "Electroplating", c. (no month) 1978, pp. 212-213.*
Van Horn, "Pulse Plating", Dynatronix, Aug. 5, 1999, pp. 1-13.*

* cited by examiner

*Primary Examiner*—Edna Wong
(74) *Attorney, Agent, or Firm*—Cooper & Dunham LLP

(57) ABSTRACT

Disclosed herein are a biaxially textured pure metal or alloy layer deposited by electroplating process on the surface of a single-crystalline or quasi-single-crystalline metal substrate, and a method for manufacturing the biaxially textured pure metal or alloy layer.

4 Claims, 7 Drawing Sheets

FIG. 1
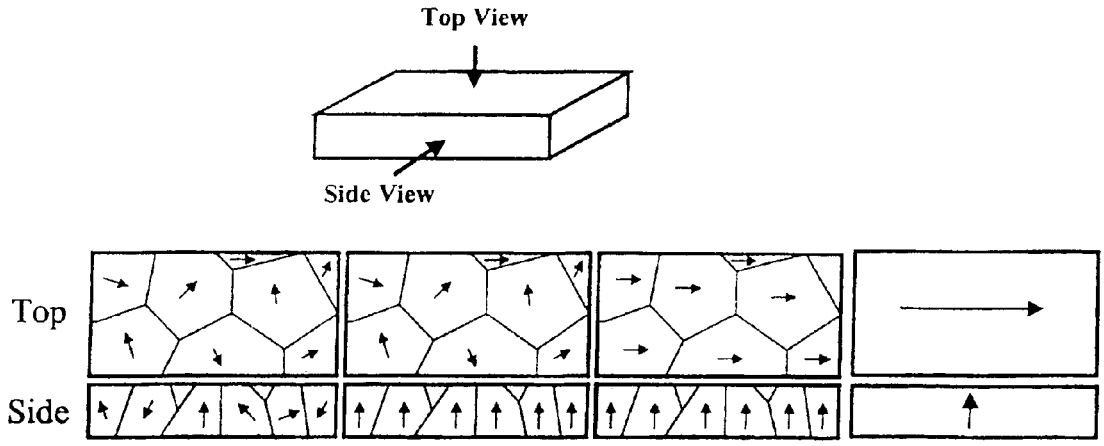
FIG. 1(a) FIG. 1(b) FIG. 1(c) FIG. 1(d)
FIG. 2
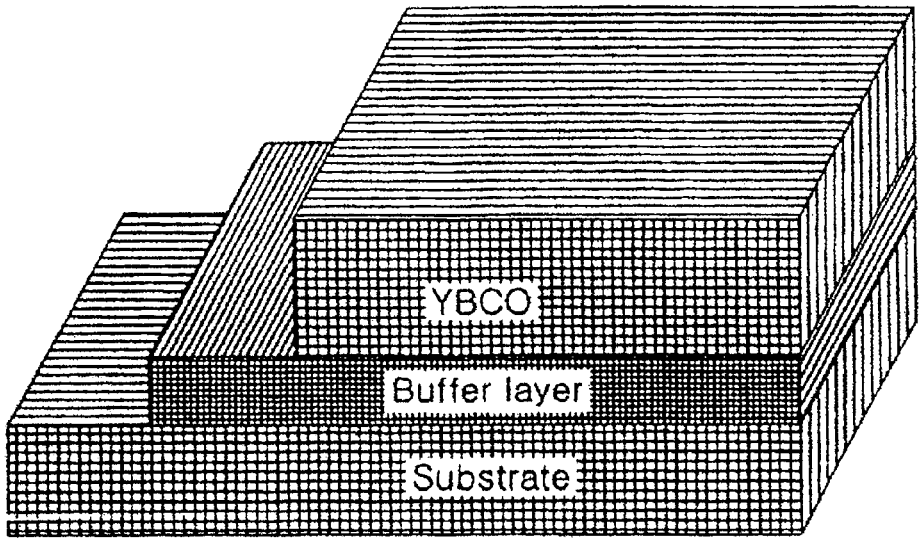

METHOD OF MANUFACTURING BIAXIALLY TEXTURED METALLIC LAYER FEATURED BY ELECTROPLATING ON THE SURFACE OF SINGLE-CRYSTALLINE OR QUASI-SINGLE-CRYSTALLINE METAL SURFACE, AND ARTICLES THEREFROM

BACKGROUND OF THE INVENTION

1. Field of the Invention

The present invention relates to a biaxially textured metal layer deposited by electroplating process on the surface of a single-crystalline or quasi-single-crystalline metal substrate, and a method for manufacturing the biaxially textured metal layer. More particularly, the present invention relates to a biaxially textured pure metal or alloy layer deposited by electroplating process on the surface of a pure metal or alloy substrate having single-crystalline or quasi-single-crystalline orientation, and a method for manufacturing the biaxially textured pure metal or alloy layer in which the surface of the pure metal or alloy layer is used as a cathode.

2. Description of the Related Art

Most of presently used materials are in the form of polycrystals. A large amount of polycrystalline materials have some crystallographic orientations.

FIG. 1 schematically shows the microstructures of the materials with various types of grain alignments. Specifically, FIG. 1(*a*) shows a material having randomly oriented crystal grains in any direction. FIG. 1(*b*) shows a material in which the crystal grains are well oriented in the direction perpendicular to the plane of a substrate but are randomly oriented in the direction parallel to the plane of the substrate. This material texture herein refers to "uniaxial texture".

On the other hand, FIG. 1(*c*) shows a polycrystalline material in which the crystal grains are well aligned in the directions perpendicular and parallel to the plane of the substrate. Such texture of the metal material herein refers to "biaxial texture". The biaxially textured material is featured by the crystallographic orientation similar to that of single crystals, as shown in FIG. 1(*d*).

Since the texture of materials influence the mechanical and electrical properties, many trials to control the orientation of the grains constituting the material have been performed. For example, magnetization largely depends on the orientation of crystal grains, e.g., a Fe-based metal is likely to be magnetized in the <100> direction.

Thus, {110}<100> or {100}<100>-oriented silicon steels are suitable for magnetic cores of electric devices such as transformers, motors, etc. In particular, magnetic loss and magnetic permeability of electrical steel can be improved by enhancing grain alignments. Accordingly, studies on the improvement of texture for reducing the weight of electric power devices and coil current are actively in progress.

In addition, in the case of YBCO-based high temperature superconducting wires, current transport properties largely depend on the orientation of superconducting grains. Accordingly, in order to manufacture superconducting wires having a high critical current density (Jc), superconducting crystal grains must be biaxially aligned within a few degrees.

As shown in FIG. 2, trials to impart a biaxial orientation to crystal grains of superconductors using a highly {100}<100>-oriented metal substrate have proved to be quite successful.

ORNL (Oak Ridge National Lab.) of the USA developed a so-called RaBiTS (Rolling-assisted Biaxially Textured Substrate) process, which is currently used to manufacture biaxially oriented metallic substrates required for fabricating superconducting wires.

Specifically, the RaBiTS process is used to manufacture biaxially oriented substrates for YBCO superconducting wires through rolling of a base metal and subsequent annealing.

In addition, in the case of grain-oriented electrical steel used as magnetic cores of electrical devices such as transformers, motors, etc., rolling and post-heating processes are used to induce highly oriented texture.

The rolling/post-heating process has an advantage that uniform and biaxially oriented substrates can be mass-produced.

However, the process requires large-scale facilities to carry out the rolling and post-annealing process, and it is not easy to manufacture thin and biaxially oriented metal substrates having a thickness of 100 μm or less. The difficulty is due to various problems associated with the rolling, such as cracks, nonuniform thickness, etc.

In particular, in order to use superconducting wires in large-scale power electric devices such as motors, magnets, etc., the superconducting wires must have high engineering critical current density (Je). Accordingly, thin metal substrates are advantageous because a part of the substrates do not participate in the electric power transmission.

In addition, in the case of grain-oriented electrical steel used as magnetic cores of electric devices such as transformers, etc., since eddy current loss due to the alternating current is proportional to the square of the thickness of the steel plates, thin and uniform plates are desired in terms of high efficiency.

On the other hand, grain-oriented metal plates can be realized by electroplating process, in addition to the rolling/post-annealing process discussed above. When the electroplating process is employed to manufacture a metal substrate for superconducting wires, a biaxially oriented substrate can be manufactured in a simple manner with low operating costs, compared to conventional processes using the rolling and high temperature heat treatment.

However, it is known that most of metal layers deposited by the electroplating process have high orientation on the c-axis, but no orientation on the a- or b-axis. Since only uniaxial texture can be induced by the conventional electroplating process, and thus metal layers formed by the electroplating process have fiber texture.

The present inventors reported in Korean Patent No. 352976 and U.S. Pat. No. 6,346,181 that when an external magnetic field is applied during electroplating, biaxial orientation can be induced.

These patents meet the novelty condition of patentability in which a biaxially oriented layer can be manufactured by appropriately arranging the position of electrodes and a magnetic field source. However, the biaxially oriented layer has a disadvantage of low degree of biaxial texture ($\Delta\omega \sim 7°$, $\Delta\Phi \sim 21$), compared to conventional processes using the rolling/post-heating ($\Delta\omega \sim 7°$, $\Delta\Phi \sim 8°$),.

In contrast, a biaxially textured pure metal or alloy layer manufactured using a single-crystalline or quasi-single-crystalline metal substrate, in accordance with the present invention has larger degree of biaxial orientation ($\Delta\omega \sim 4°$, $\Delta\Phi \sim 5.2°$) than conventional metal layers manufactured using the rolling/post-heating as well as the electroplating process.

Accordingly, since the present invention provides a metal layer having higher degree of biaxial texture than conventional metal layers manufactured using the rolling/post-annealing as well as the electroplating process, it may pave the way for future industrial applications of magnetic materials and superconductors.

SUMMARY OF THE INVENTION

Therefore, the present invention has been made in view of the above problems, and it is an object of the present invention to provide a biaxially textured pure metal or alloy layer deposited by electroplating process on the surface of metallic substrate having single-crystalline or quasi-single-crystalline orientation in an appropriate plating bath, wherein the biaxially textured pure metal or alloy layer has a thickness of a few tens μm on the surface of metallic substrate having single-crystalline or quasi-single-crystalline orientation.

It is another object of the present invention to provide a method for manufacturing the biaxially textured pure metal or alloy layer.

In order to accomplish the above objects of the present invention, there is provided a method for manufacturing a biaxially textured pure metal or alloy layer deposited by electroplating process on the surface of metallic substrates having single-crystalline or quasi-single-crystalline orientation. In addition, the electrodepositions of the biaxially textured articles are performed in a direct current electroplating process (DC process), a pulse current electroplating process (PC process) or a periodic reverse current plating process (PR process).

In accordance with one embodiment of the present invention, there is provided a method for manufacturing a biaxially textured pure metal or alloy layer deposited by electroplating process on the surface of a pure metal or alloy substrate having single-crystalline or quasi-single-crystalline orientation, the biaxially textured pure metal or alloy layer being electroplated in a plating solution comprising 100~400 g/l nickel sulfate, 0~70 g/l nickel chloride, 20~80 g/l boric acid, 0~50 g/l sodium sulfate, 0~10 g/l sodium tungstate and 0~10 g/l cobalt chloride at pH 1.5~7 and 50~80° C.

In accordance with another embodiment of the present invention, there is provided a method for manufacturing a biaxially textured pure metal or alloy layer deposited by electroplating process on the surface of a pure metal or alloy substrate having single-crystalline or quasi-single-crystalline orientation, the biaxially textured pure metal or alloy layer being deposited in the plating solution at a cathode current density of 3~20 A/dm$^2$ using a direct current electroplating process (DC process), the deposited pure metal or alloy layer having a texture fraction (TF) of 0.97 or more on the (001) plane.

In accordance with another embodiment of the present invention, there is provided a method for manufacturing a biaxially textured pure metal or alloy layer deposited by electroplating process on the surface of a pure metal or alloy substrate having single-crystalline or quasi-single-crystalline orientation, the biaxially textured pure metal or alloy layer being deposited in the plating solution under conditions of a cathode current density of 3~20 A/dm$^2$, a cathode current time of 1~100msec and a down time of 1~100msec using a pulse current electroplating process (PC process), the deposited pure metal or alloy layer having a texture fraction (TF) of 0.97 or more on the (001) plane.

In accordance with another embodiment of the present invention, there is provided a method for manufacturing a biaxially textured pure metal or alloy layer deposited by electroplating process on the surface of a pure metal or alloy substrate having single-crystalline or quasi-single-crystalline orientation, the biaxially textured pure metal or alloy layer being deposited in the plating solution under conditions of a cathode current density of 3~20 A/dm$^2$, a cathode current time of 1~100 msec and an anode current time of 1~100 msec using a periodic reverse current plating process (PR process), the deposited pure metal or alloy layer having a texture fraction (TF) of 0.97 or more on the (001) plane.

In accordance with another aspect of the present invention, there is provided a biaxially textured pure metal or alloy layer deposited by electroplating process on the surface of a pure metal or alloy substrate having single-crystalline or quasi-single-crystalline orientation.

In accordance with yet another embodiment of the present invention, there is provided a biaxially textured pure metal or alloy layer deposited by electroplating process on the surface of a pure metal or alloy substrate having single-crystalline or quasi-single-crystalline orientation, the biaxially textured pure metal or alloy layer having an orientation perpendicular to the pure metal or alloy substrate, and being a cubic crystal texture having a misorientation on the c-axis of 8° or less and a misorientation on the plane formed by the a-axis and b-axis of 15° or less in which the misorientation on the c-axis is determined by a Full Width at Half Maximum of peaks on the θ-rocking curve and the misorientation on the plane formed by the a-axis and b-axis is determined by a Full Width at Half Maximum of peaks on the Φ-scan.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a conceptual diagram showing changes in the texture according to the orientation of crystal grains constituting a metal material;

FIG. 2 is a conceptual diagram schematically showing a structure of an YBCO-based superconducting wire;

Figure 7:
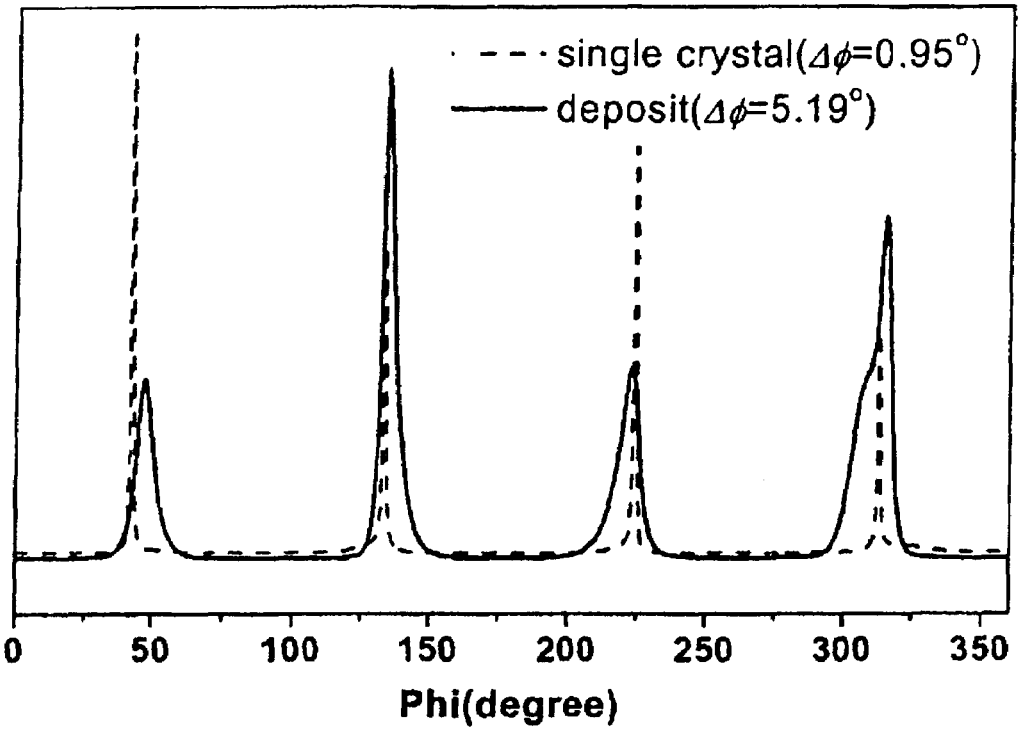
Figure 8:
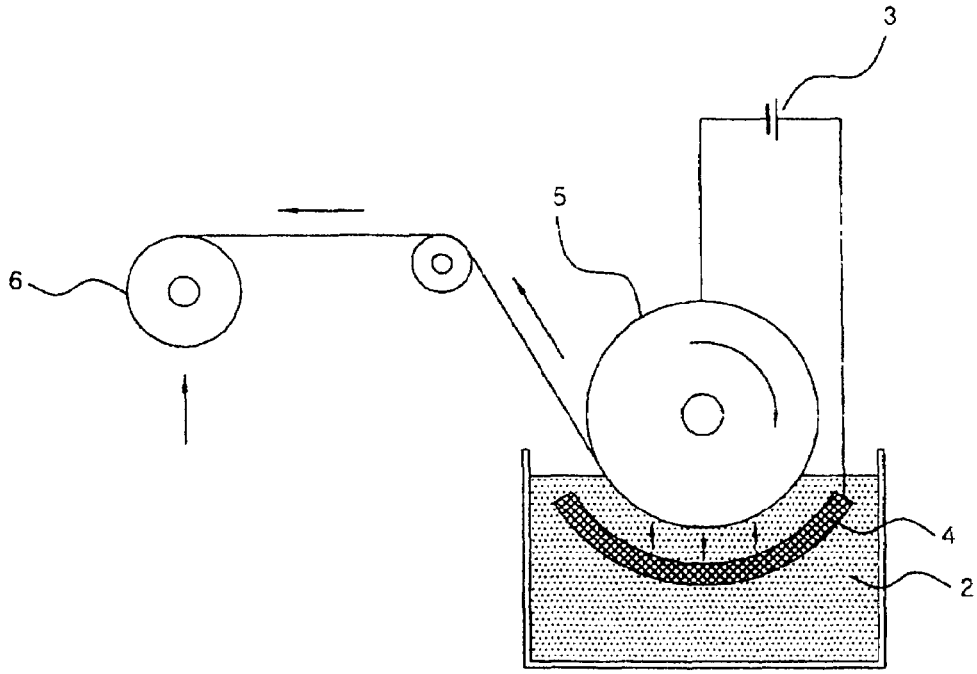
Figure 9:
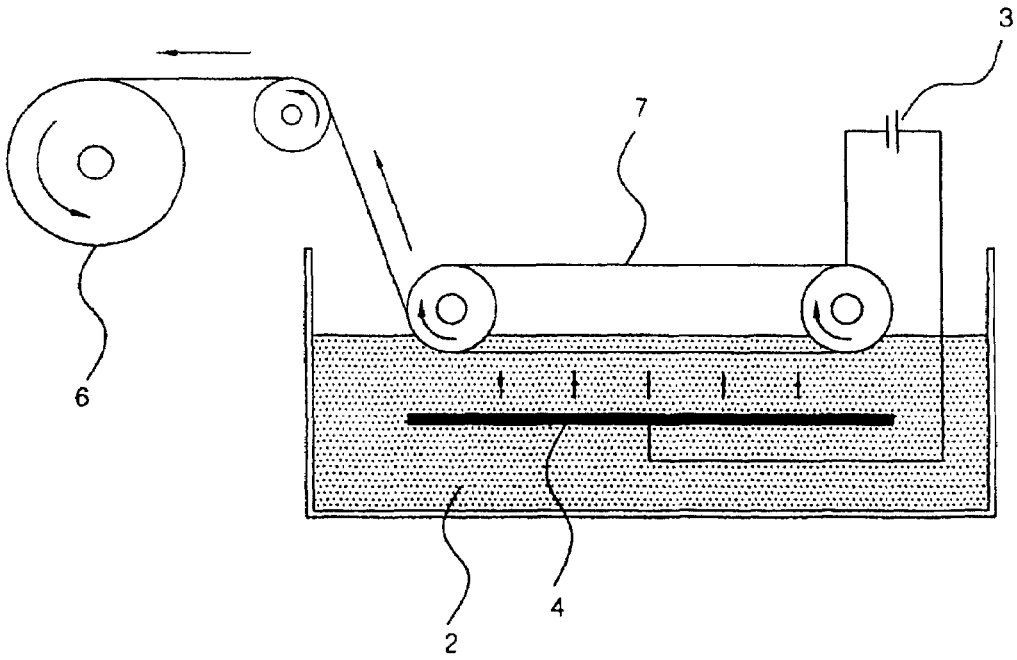
Figure 10:
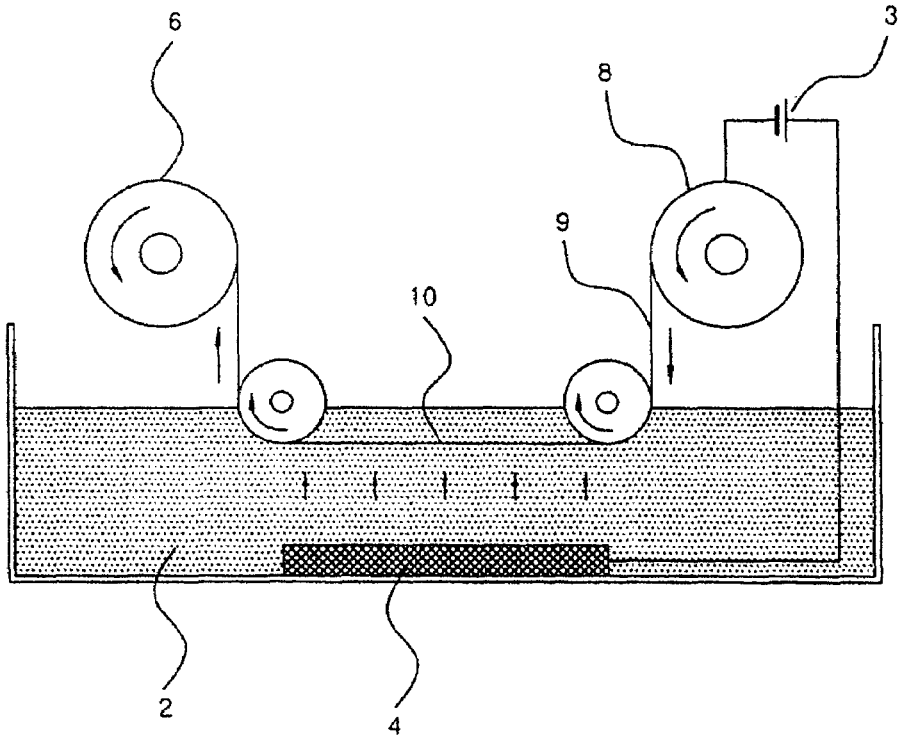

FIG. **6*a*** is a (111) XRD pole figure of a single-crystalline base metal, used in a method of the present invention. The XRD pole figure allows the analysis of the in-plane textures of the single-crystalline base metal;

FIG. **6*b*** is a (111) XRD pole figure of a deposited layer, manufactured by a method of the present invention. The XRD pole figure allows the analysis of the in-plane textures of the deposited layer;

FIG. 7 is X-ray diffraction patterns (Φ-scan) of a deposited layer manufactured by a method of the present invention, and a single-crystalline base metal, respectively;

FIG. 8 is a schematic diagram showing a continuous plating apparatus using a cylindrical cathode;

FIG. 9 is a schematic diagram showing a continuous plating apparatus using a belt-shaped cathode; and FIG. 10 is a schematic diagram showing an apparatus for plating a biaxially textured metal layer on a long wire-shaped biaxial metal substrate.

DESCRIPTION OF THE PREFERRED EMBODIMENTS

Hereinafter, the present invention will be explained in more detail with reference to the accompanying drawings.

First, a method for manufacturing a biaxially textured metal layer deposited by electroplating process on the surface of a single-crystalline or quasi-single-crystalline metal is described in more detail, in terms of the electroplating process.

Figure 3:
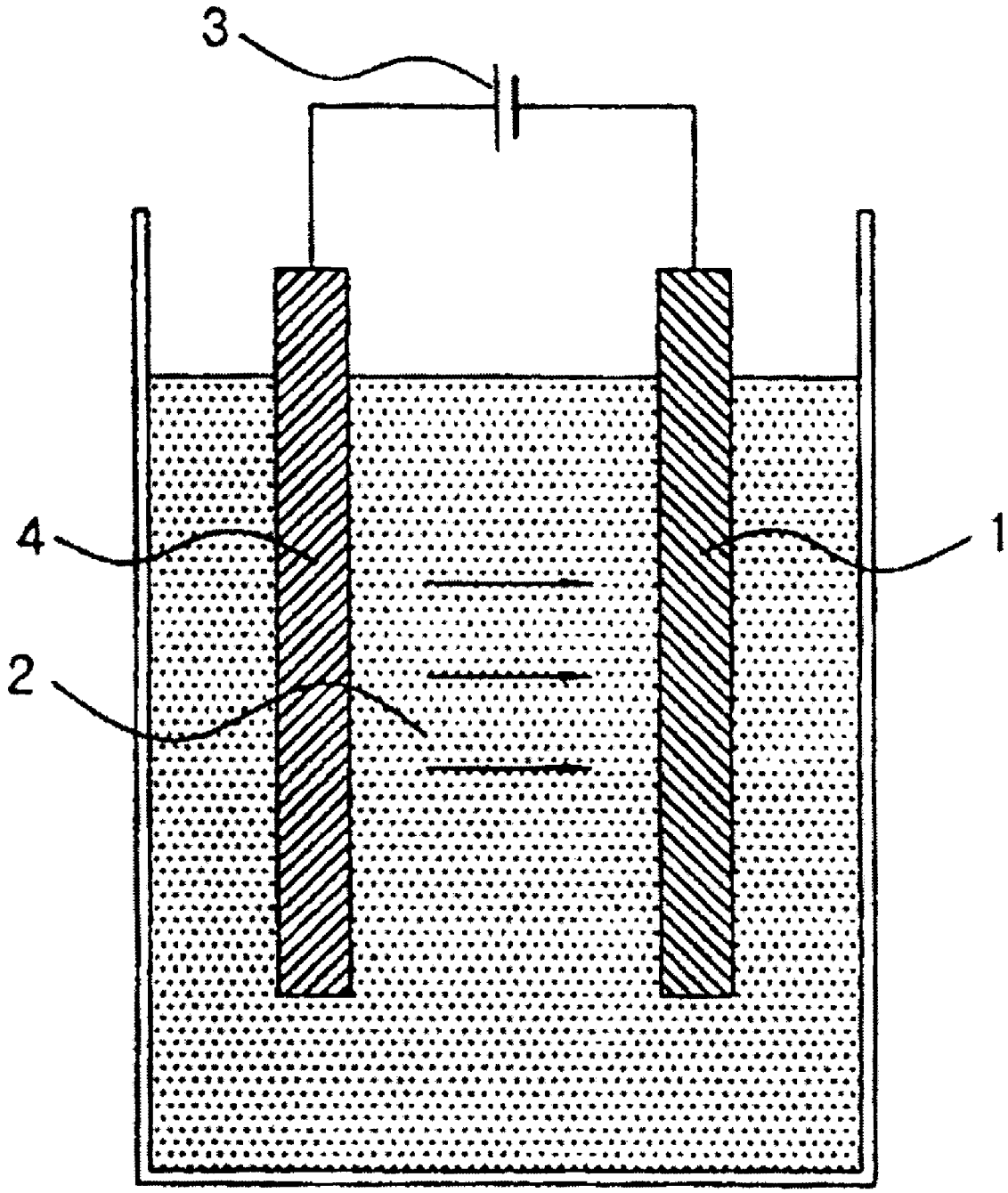
FIG. 3 is a schematic diagram showing an electroplating apparatus used in the present invention.

As shown in FIG. 3, the electroplating process is carried out by dipping an anode 4 and a cathode 1 in a plating solution 2, and growing a metal layer on the cathode 1 using an appropriate power supply.

The shorter the distance between the anode 4 and the cathode 1 is, the higher the orientation of the grown metal layer is. This is because the short distance between the anode 4 and the cathode 1 leads to the formation of a uniform electric field between both electrodes.

The plating solution is an aqueous solution comprising 100~400 g/l nickel sulfate ($NiSO_4$), 0~70 g/l nickel chloride ($NiCl_2$), 20~80 g/l boric acid, 0~50 g/l sodium sulfate ($Na_2SO_4$), 0~10 g/l sodium tungstate ($NaWO_3$) and 0~10 g/l cobalt chloride ($CoCl_2$).

The pH of the plating solution is preferably within the range of 1.5~5, and more preferably 2~4. At a pH of 2~4, the highest (100) orientation can be obtained. The temperature of the plating solution is preferably within the range of 50~80° C.

The thickness of the deposited layer can be appropriately controlled within the range of 10~300 μm. As the anode material, a nickel plate having a purity of 99% or higher can be used. Any metal plates of which texture is similar to that of single crystal can be used as the cathode material.

Specifically, as the cathode material, single crystals of Ni, Cu, Fe, etc., or biaxially oriented metal plates manufactured through rolling and post-annealing process can be used. As the electroplating process, a direct current electroplating process (DC process), a pulse current electroplating process (PC process) or a periodic reverse current plating process (PR process) may be employed.

The electroplating conditions are dependent on the electroplating processes. In all the electroplating processes, the average current density is within the range of 3~20 A/dm$^2$. As for the pulse current electroplating process (PC process), the cathode current time and the down time are within the range of 1~100 msec.

On the contrary, the cathode current time and the anode current time are within the range of 1~100 msec in the periodic reverse current plating process (PR process).

Characteristics of the metal layer deposited on the substrate are measured in accordance with the following procedures.

First, the angle of misorientation between crystal grains must be small enough to obtain desired texture characteristics.

The texture characteristics are evaluated by an X-ray diffraction method, and a texture fraction (TF) in the direction perpendicular to the deposited plane is measured on the 20-θ scan.

The texture fraction (TF) in the direction perpendicular to the deposited plane is quantitatively measured by the following equation 1 using the ratio between integrated intensities of diffraction peaks.

$$TF = \frac{I_{hkl} / I^{o}_{hkl}}{\sum_{hkl} I_{hkl} / I^{o}_{hkl}} \qquad \text{Equation 1}$$

where $I_{hkl}$ and $I_{hkl}^{0}$ are integrated intensities of XRD peaks from experimental measurement and standard powder diffraction profiles, respectively.

The misorientation on the c-axis direction is determined by a Full Width at Half Maximum (FWHM) of peaks on the θ-rocking curve wherein the Full Width at Half Maximum of peaks is obtained by fitting the θ-rocking curve to the Gaussian function.

The presence of orientation on the a- or b-axis is identified by measuring a pole figure at the (111) pole. The misorientation in the plane formed by the a-axis and b-axis is determined by performing a Φ-scan at a tilt angle (Ψ) of 54.7°, and measuring a Full Width at Half Maximum of peaks on the Φ-scan.

The Full Width at Half Maximum of peaks on the Φ-scan is obtained by fitting peaks on the Φ-scan to the Gaussian function. From the obtained values, average are calculated.

Hereinafter, the present invention will be described in more detail with reference to the following Examples.

EXAMPLE 1

Ni was plated on a nickel (100) single crystal substrate in accordance with the following procedure.

A high purity nickel plate (99% or higher) was used as an anode material, and a Ni (100) single crystal was used as a cathode material.

As a plating solution, a solution comprising 250 g/l nickel sulfate, 15 g/l nickel chloride and 20 g/l boric acid was used. A periodic reverse current plating process (PR process) was performed under conditions of a plating temperature of 60° C. and an average current density of 5 A/dm$^2$ to manufacture a deposited layer having a thickness of about 50 μm.

The crystal orientation of the deposited layer was analyzed. The results are summarized in Table 1 below.

TABLE 1

| | |
|---|---|
| Electroplating process | PR process |
| Anode material (deposited plate) | High purity nickel plate |
| Cathode material (substrate) | Ni (100) single crystal |
| Thickness of deposited layer | 50 μm |
| Texture fracture (TF) | 0.98 |
| Full Width at Half Maximum on θ-rocking curve | 3.9° |
| Full Width at Half Maximum on Φ-scan | 5.19° |

Figure 4:
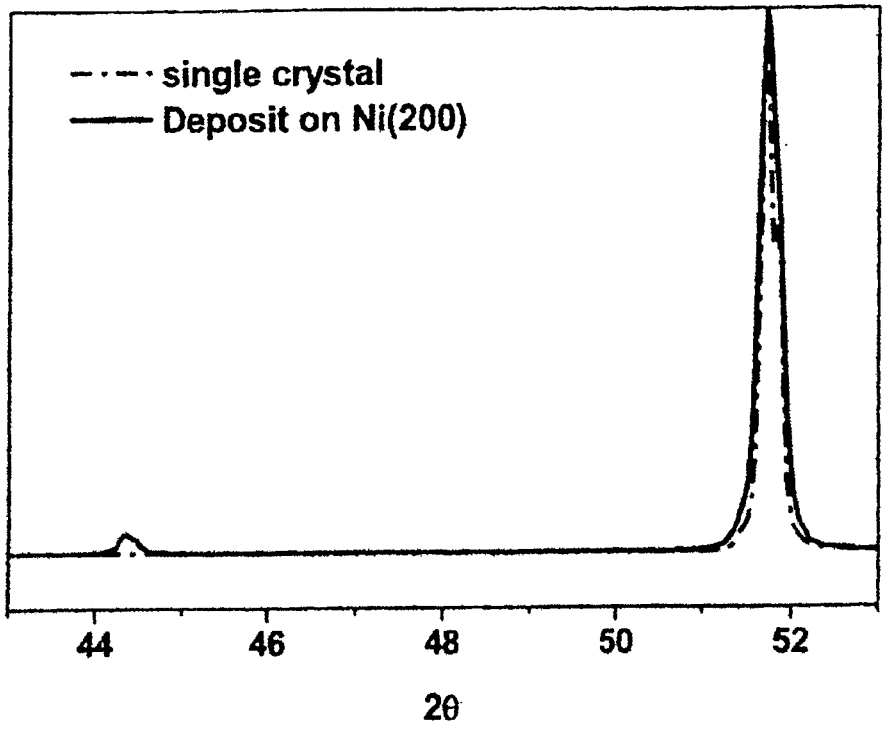
FIG. 4 is X-ray diffraction patterns (20-θ scan) of a deposited layer manufactured by a method of the present invention, and a single-crystalline base metal, respectively.

X-ray diffraction patterns of the Ni-deposited layer thus manufactured are shown in FIG. 4. The results showed that the (001) peak was distinctly observed and the texture fraction (TF) in the direction perpendicular to the plated plane was as high as 0.98.

Figure 5:
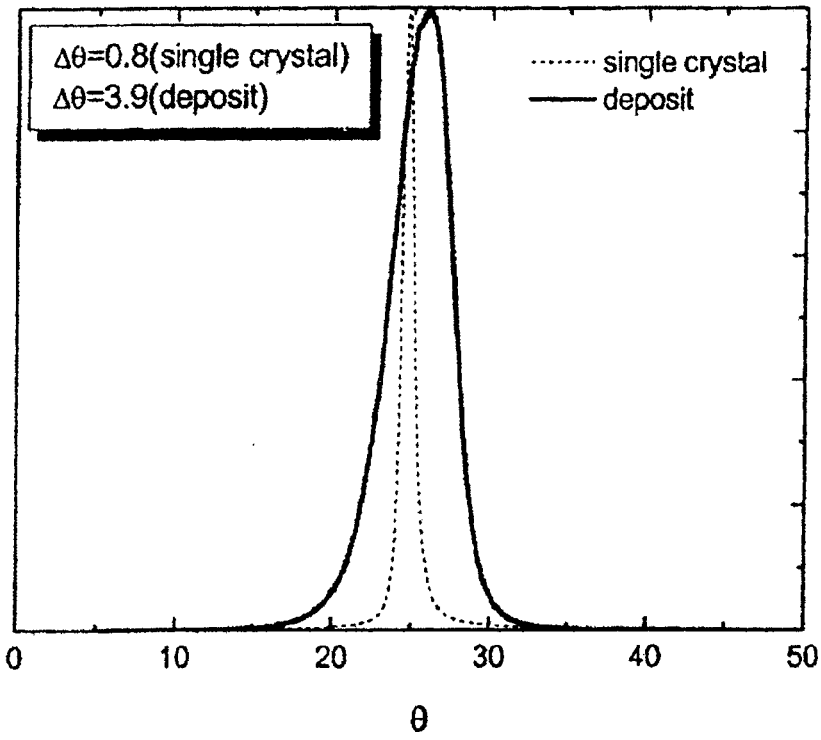
FIG. 5 is X-ray diffraction patterns (ω-scan) of a deposited layer manufactured by a method of the present invention, and a single-crystalline base metal, respectively.
Figure 6A:
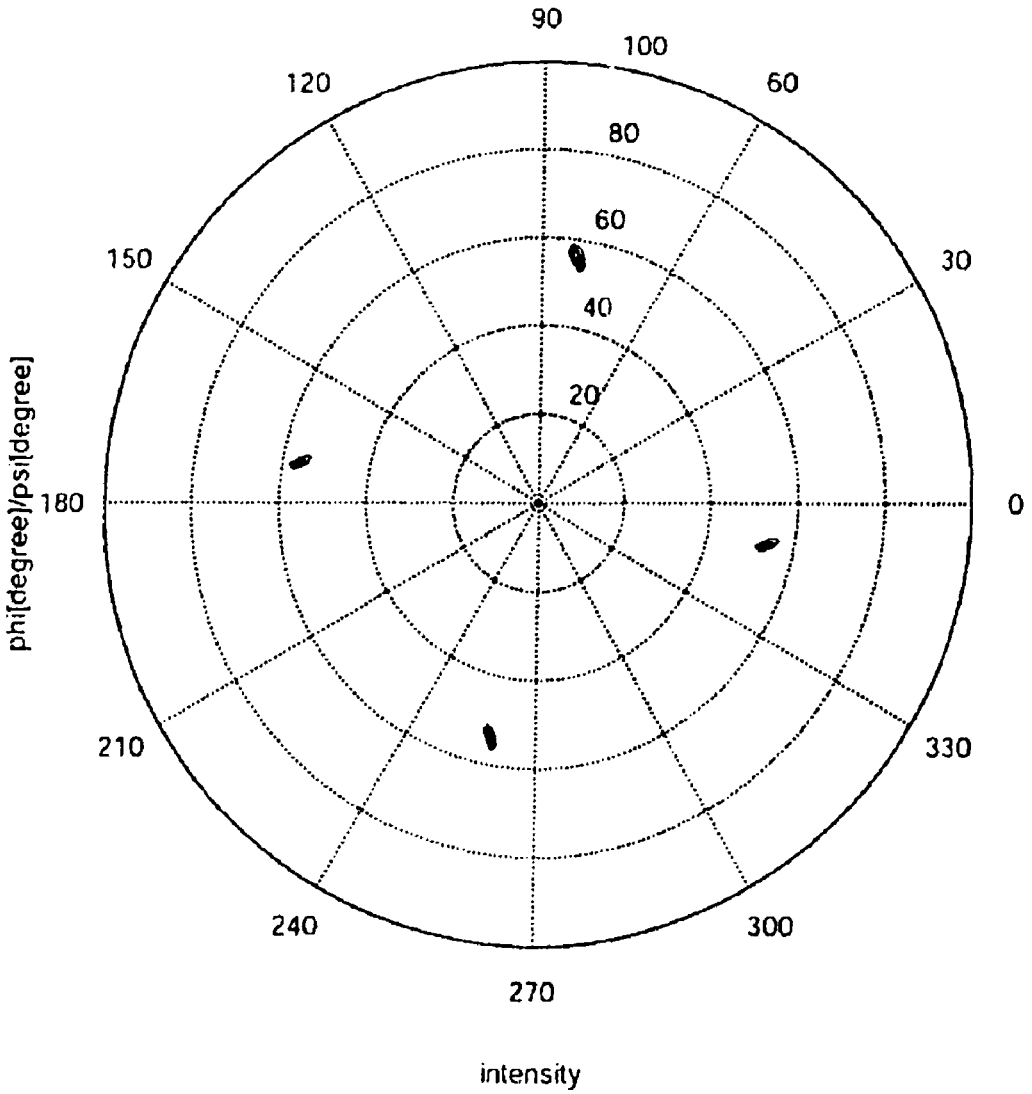

On the other hand, c-axis alignment on the (001) plane was evaluated based on the θ-rocking curve (FIG. 5). The Full Width at Half Maximum of peaks was shown to be 3.9°. The (111) pole figure was measured to evaluate the biaxial texture of the deposited layer. The results for a single crystalline base metal are shown in FIG. 6*a*.

Figure 6B:
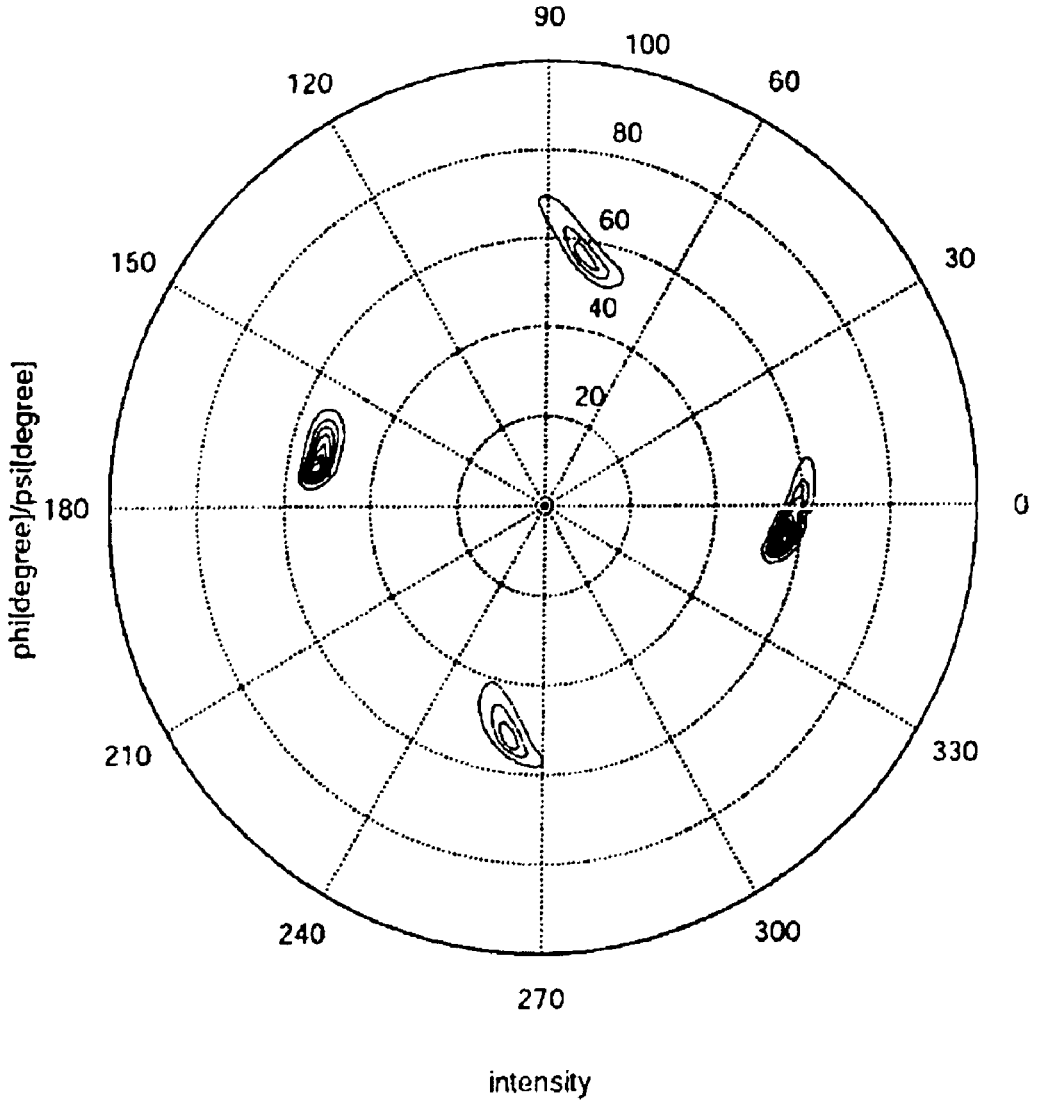

FIG. 6*b* is a pole figure of the deposited layer at the (111) pole. As can be seen from FIG. 6*b*, distinct contours were observed at points (Ψ angle: 54.7°) away from the origin in the pole figure of the Ni-deposited layer, as well as in the pole figure of the Ni-single crystal. In addition, the distinct contours were observed to be spaced at an interval of 90°. These observations suggest that the Ni-deposited layer has [100]<100>-oriented cubic crystal texture.

On the other hand, the Full Width at Half Maximum of the deposited layer on the Φ-scan at a tilt angle (Ψ) of 54.7° was shown to be 5.19°.

EXAMPLE 2

In this Example, a high purity nickel plate was used as an anode material, and a high purity copper (100)-single crystal was used as a cathode material.

As a plating solution, a solution comprising 250 g/l nickel sulfate, 35 g/l nickel chloride and 55 g/l boric acid was used. A direct current electroplating process (DC process) was performed under conditions of a plating temperature of 60° C. and an average current density of 4 A/dm$^2$ to manufacture a deposited layer having a thickness of about 50 μm.

The crystal orientation of the deposited layer was analyzed. The results are shown in Table 2 below.

TABLE 2

| | |
|---|---|
| Electroplating process | DC process |
| Anode material (deposited plate) | High purity nickel (Ni) |
| Cathode material (substrate) | Cu (100) single crystal |
| Thickness of deposited layer | 50 μm |
| Texture fracture (TF) | 0.97 |
| Full Width at Half Maximum on θ-rocking curve | 4.2° |
| Full Width at Half Maximum on Φ-scan | 6.3° |

EXAMPLE 3

In this Example, a Ni—Co layer was deposited on a nickel (100)-single crystal using a direct current electroplating process (DC process). At this time, the Co component was originated from cobalt chloride ($COCl_2$) added to a plating solution.

A high purity nickel plate was used as an anode material, and a high purity nickel (100)-single crystal was used as a substrate.

As a plating solution, a solution comprising 350 g/l nickel sulfate, 25 g/l nickel chloride, 55 g/l boric acid and 5 g/l cobalt chloride was used. A direct current electroplating process (DC process) was performed under conditions of a plating temperature of 70° C. and an average current density of 5 A/dm$^2$ to manufacture a deposited layer having a thickness of about 80 μm.

The crystal orientation of the deposited layer was analyzed. The results are shown in Table 3 below.

TABLE 3

| | |
|---|---|
| Electroplating process | DC process |
| Anode material (deposited plate) | High purity nickel (Ni-Co) |
| Cathode material (substrate) | Ni (100) single crystal |
| Thickness of deposited layer | 80 μm |
| Texture fracture (TF) | 0.97 |
| Full Width at Half Maximum on θ-rocking curve | 7.2° |
| Full Width at Half Maximum on Φ-scan | 10.3° |

EXAMPLE 4

Ni—W plating was performed in accordance with the following procedure. A high purity nickel plate was used as an anode material, and a copper (Cu) (100) single crystal was used as a cathode substrate material.

As a plating solution, a solution. comprising 250 g/l nickel sulfate, 50 g/l boric acid, 50 g/l sodium sulfate and 10 g/l sodium tungstate ($NaWO_3$) was used. The sodium tungstate ($NaWO_3$) was added to manufacture a W component-containing Ni—W layer.

A periodic reverse current plating process (PR process) was performed under conditions of a plating temperature of 60° C. and an average current density of 8 A/dm$^2$ to manufacture a deposited layer.

The crystal orientation of the deposited layer was analyzed. The results are shown in Table 4 below.

TABLE 4

| | |
|---|---|
| Electroplating process | PR process |
| Anode material (deposited plate) | High purity nickel (Ni-W) |
| Cathode material (substrate) | Cu (100) single crystal |
| Thickness of deposited layer | 70 μm |
| Texture fracture (TF) | 0.96 |
| Full Width at Half Maximum on θ-rocking curve | 4.9° |
| Full Width at Half Maximum on Φ-scan | 8.3° |

EXAMPLE 5

In this Example, a high purity nickel plate was used as an anode material, and a biaxially oriented nickel substrate ({100}<100> orientation) was used as a cathode substrate material.

As a plating solution, a solution comprising 250 g/l nickel sulfate, 15 g/l nickel chloride and 20 g/l boric acid was used. A periodic reverse current plating process (PR process) was performed under conditions of a plating temperature of 60° C. and an average current density of 3 A/dm$^2$ to manufacture a deposited layer.

The crystal orientation of the deposited layer was analyzed. The results are shown in Table 5 below.

TABLE 5

| | |
|---|---|
| Electroplating process | PR process |
| Anode material (deposited plate) | High purity nickel |
| Cathode material (substrate) | Biaxially oriented Ni ({100}<100> orientation) |
| Thickness of deposited layer | 30 μm |
| Texture fracture (TF) | 0.97 |
| Full Width at Half Maximum on θ-rocking curve | 5.7° |
| Full Width at Half Maximum on Φ-scan | 8.3° |

EXAMPLE 6

In this Example, a high purity nickel plate was used as an anode material, and a biaxially oriented Fe—Si substrate ({100}<100> orientation) was used as a cathode substrate material.

As a plating solution, a solution comprising 250 g/l nickel sulfate, 35 g/l nickel chloride and 55 g/l boric acid was used. A direct current electroplating process (DC process) was performed under conditions of a plating temperature of 60° C. and an average current density of 4 A/dm$^2$ to manufacture a deposited layer.

The crystal orientation of the deposited layer was analyzed. The results are shown in Table 6 below.

TABLE 6

| | |
|---|---|
| Electroplating process | DC process |
| Anode material (deposited plate) | High purity nickel |
| Cathode material (substrate) | Biaxially oriented Fe—Si ({100}<100> orientation) |

TABLE 6-continued

| | |
|---|---|
| Thickness of deposited layer | 50 μm |
| Texture fracture (TF) | 0.98 |
| Full Width at Half Maximum on θ-rocking curve | 5.1° |
| Full Width at Half Maximum on Φ-scan | 8.6° |

EXAMPLE 7

In this Example, a high purity nickel plate was used as an anode material, and a biaxially oriented nickel substrate ({100}<100> orientation) was used as a cathode substrate material.

As a plating solution, a solution comprising 350 g/l nickel sulfate, 55 g/l boric acid and 5 g/l cobalt chloride was used. A direct current electroplating process (DC process) was performed under conditions of a plating temperature of 70° C. and an average current density of 5 A/dm$^2$ to manufacture a deposited layer.

The crystal orientation of the deposited layer was analyzed. The results are shown in Table 7 below.

TABLE 7

| | |
|---|---|
| Electroplating process | DC process |
| Anode material (deposited plate) | High purity nickel |
| Cathode material (substrate) | Biaxially oriented nickel ({100}<100> orientation) |
| Thickness of deposited layer | 80 μm |
| Texture fracture (TF) | 0.95 |
| Full Width at Half Maximum on θ-rocking curve | 7.9° |
| Full Width at Half Maximum on Φ-scan | 13.2° |

EXAMPLE 8

In this Example, a high purity nickel plate was used as an anode material, and a biaxially oriented Fe—Si substrate ({100}<100> orientation) was used as a cathode substrate material.

As a plating solution, a solution comprising 250 g/l nickel sulfate, 50 g/l boric acid, 50 g/l sodium sulfate and 10 g/l $NaWO_3$ was used. A periodic reverse current plating process (PR process) was performed under conditions of a plating temperature of 60° C. and an average current density of 8 A/dm$^2$ to manufacture a deposited layer.

The crystal orientation of the deposited layer was analyzed. The results are shown in Table 8 below.

TABLE 8

| | |
|---|---|
| Electroplating process | PR process |
| Anode material (deposited plate) | High purity nickel |
| Cathode material (substrate) | Biaxially oriented Fe—Si ({100}<100> orientation) |
| Thickness of deposited layer | 70 μm |
| Texture fracture (TF) | 0.98 |
| Full Width at Half Maximum on θ-rocking curve | 6.2° |
| Full Width at Half Maximum on Φ-scan | 9.3° |

EXAMPLE 9

The method according to the present invention can be applied for manufacturing a long wire-shaped and biaxially textured metal layer. FIG. 8 is a schematic diagram showing a continuous plating apparatus for manufacturing the long wire-shaped and biaxially textured metal layer.

The continuous plating apparatus comprises an anode 4 and a cylindrical cathode 5 dipped in a plating solution 2, and a take-up reel 6. The cylindrical cathode 5 is rotated to form a biaxially textured metal layer thereon. The biaxially textured metal layer is peeled off, and wound by the take-up reel 6.

In order to impart a biaxial texture to the metal layer, the surface of the cylindrical cathode 5 is made of a biaxially textured metal material or single crystal.

To form a uniform electric field between the electrodes, the anode 4 has preferably a curved surface. The thickness and crystallinity of the biaxially textured metal layer can be varied by controlling the rotational speed of the cylindrical cathode 5, current intensity and the like. The continuous plating process can be widely modified.

EXAMPLE 10

This Example is a modification of Example 9. FIG. 9 is a schematic diagram showing an apparatus for carrying out this Example. The apparatus comprises an anode 4 and a belt-shaped cylindrical cathode 7 dipped in a plating solution 2, and a take-up reel 6. The belt-shaped cylindrical cathode 7 is appropriately rotated to form a biaxially textured metal layer thereon. The biaxially textured metal layer is peeled off, and wound by the take-up reel 6.

In order to impart a biaxial texture to the metal layer, the surface of the belt-shaped cathode 10 is made of a biaxially textured metal material or single crystal.

EXAMPLE 11

Unlike Examples 9 and 10, this Example provides a method for manufacturing a desired biaxially textured metal layer deposited by electroplating process on the surface of a long wire-shaped and biaxially oriented substrate. FIG. 10 is a schematic diagram showing an apparatus for carrying out this Example. The apparatus comprises an anode 4 dipped in a plating solution 2, a preliminary reel 8, a long wire-shaped and biaxially oriented substrate 9, a take-up reel 6 and power supply 3.

A long wire-shaped and biaxially textured metal layer is deposited on the surface of a long wire-shaped and biaxially oriented cathode 10. The long wire-shaped and biaxially textured metal layer deposited on the long wire-shaped and biaxially oriented substrate 9 is wound by the take-up reel 6.

As apparent from the above description, in accordance with the present invention, biaxially textured pure metal and alloy layers can be provided through electroplating process. The biaxially textured pure metal and alloy layers thus manufactured exhibit excellent texture compared to those manufactured through conventional processes. The biaxially textured pure metal and alloy layers of the present invention can be used as metal substrates for superconducting wires and thin film magnetic materials. In addition, the method of the present invention does not require cold rolling and high temperature treatment processes, and thus is advantageous in terms of low operational and installation costs and high productivity. Furthermore, the biaxially textured metallic layers can be manufactured simply by electroplating process without the need for additional processes. Accordingly, the present invention is expected to greatly contribute to the development of electroplating processes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method for manufacturing a biaxially textured metal material comprising the steps of, manufacturing a plating solution comprising 100~400 g/l nickel sulfate, 70 g/l or less nickel chloride, 20~80 g/l boric acid, 50 g/l or less sodium sulfate, 10 g/l or less sodium tungstate and 10 g/l or less cobalt chloride at pH 2~4 and 50~80° C.;

depositing a biaxially textured metal layer by an electroplating process in the plating solution on the surface of a rotating cylindrical cathode having a single-crystalline or a quasi-single-crystalline orientation; and peeling the deposited biaxially textured metal layer off the rotating cylindrical cathode after electroplating wherein the peeled biaxially textured metal layer has substantially the same crystalline orientation as that of the rotating cylindrical cathode.

2. The method for manufacturing a biaxially textured metal material according to claim 1, wherein the electroplating process is a direct current electroplating process (DC process) in which the biaxially textured metal layer is deposited in the plating solution at a cathode current density of 3~20 A/dm$^2$, and the deposited metal layer has a texture fraction (TF) of 0.97 or more on the (001) plane.

3. The method for manufacturing a biaxially textured metal material according to claim 1, wherein the electroplating process is a pulse current electroplating process (PC process) in which the biaxially textured metal layer is deposited in the plating solution under conditions of a cathode current density of 3~20 A/dm$^2$, a cathode current time of 1~100 msec and a down time of 1~100 msec, and the deposited metal layer has a texture fraction (TF) of 0.97 or more on the (001) plane.

4. The method for manufacturing a biaxially textured metal material according to claim 1, wherein the electroplating process is a periodic reverse current electroplating process (PR process) in which the biaxially textured metal layer is deposited in the plating solution under conditions of a cathode current density of 32~20 A/dm$^2$, a cathode current time of 1~100 msec and an anode current time of 1~100 msec, and the deposited metal layer has a texture fraction (TF) of 0.97 or more on the (001) plane.

* * * * *